US008453999B2

(12) United States Patent
Kapich

(10) Patent No.: US 8,453,999 B2
(45) Date of Patent: Jun. 4, 2013

(54) HIGH CAPACITY WATER MISTING GUN

(76) Inventor: Davorin Kapich, Carlsbad, CA (US)

( * ) Notice: Subject to any disclaimer, the term of this patent is extended or adjusted under 35 U.S.C. 154(b) by 367 days.

(21) Appl. No.: 12/804,783

(22) Filed: Jul. 28, 2010

(65) Prior Publication Data

US 2011/0266702 A1 Nov. 3, 2011

Related U.S. Application Data

(60) Provisional application No. 61/273,072, filed on Jul. 29, 2009.

(51) Int. Cl.
*B01F 3/04* (2006.01)

(52) U.S. Cl.
USPC ..... 261/28; 261/71; 261/88; 261/116; 239/214.17; 239/265.19

(58) Field of Classification Search
USPC ..... 261/28, 34.1, 66, 71, 88, 115, 116, 261/DIG. 75; 239/214.13, 214.17, 265.19, 239/380, 381; 169/9, 14, 91
See application file for complete search history.

(56) References Cited

U.S. PATENT DOCUMENTS 3,744,773 A * 7/1973 Velander ..... 261/88
5,013,214 A * 5/1991 Kapich ..... 415/202
5,125,797 A * 6/1992 Kapich ..... 415/202
5,471,965 A * 12/1995 Kapich ..... 123/565
5,904,045 A * 5/1999 Kapich ..... 60/609
5,924,286 A * 7/1999 Kapich ..... 60/608
6,502,398 B2 * 1/2003 Kapich ..... 60/608
7,530,553 B2 * 5/2009 Kapich ..... 261/28
7,721,976 B2 * 5/2010 Nolte et al. ..... 239/224
8,220,723 B2 * 7/2012 Clark ..... 239/204
2002/0095935 A1 * 7/2002 Kapich ..... 60/599
2002/0157397 A1 * 10/2002 Kapich ..... 60/608
2003/0037546 A1 * 2/2003 Kapich ..... 60/608

* cited by examiner

*Primary Examiner* — Charles Bushey
(74) *Attorney, Agent, or Firm* — John R Ross; John R Ross, III

(57) ABSTRACT

A high-velocity water misting gun with a very high-speed radial inflow hydraulic turbine mounted on the same shaft with an axial flow air compressor wheel compressing air discharged at high velocities through an exhaust air nozzle. All of the water discharging from the hydraulic turbine wheel is channeled directly into a water misting nozzle providing a fine water mist discharging into a high-velocity air flow provided by the axial-flow compressor. Preferred embodiments utilize a manually operated ball valve to control water pressure supplied to the gun. A second valve is a manually operated turbine water bypass valve that is integral part of the preferred embodiment which allows for change of turbine power and air flow independently of water flow. With turbine water bypass valve open, most of the turbine flow is bypassed around the turbine and directly into the water misting nozzle, increasing the water flow and decreasing the air flow and air velocity. With turbine water bypass valve fully closed, hydraulic turbine power increases the power input into the compressor resulting maximum reach of the water-air mist jet.

13 Claims, 5 Drawing Sheets

HIGH CAPACITY WATER MISTING GUN

CROSS REFERENCE TO RELATED APPLICATIONS

This application claims the benefit of Ser. No. 61/273,072 filed Jul. 29, 2009.

FIELD OF THE INVENTION

This invention relates to mist devices and in particular to mist devices for fire fighting.

BACKGROUND OF THE INVENTION

Fire fighting in close quarters buildings such as in residential homes and apartments often result in heavy water damage. The reason is that use of standard fire fighting equipment usually results in the discharge large volumes of water into the homes and apartments. These volumes are usually greatly in excess of that needed to extinguish the fire. Chemical fire extinguishers are useful for putting out small fires but are not much use against larger fires.

It is known that high pressure water mist can absorb heat at very high rates due to the large surface area of very many very small droplets. The creation of very small droplets in the range of 50 to 100 microns was found by Marioff Corporation tests to increase vaporization rates by as much as 400 times the rates of conventional sprinkler drops. However, when fighting fire in close quarters the water mist must be delivered at distances of many feet and at high rates. Also, firefighters need to be able to carry such devices up several floors and use such devices single handedly.

Fire fighting using high velocity water turbine driven fans has been in use for number of years. U.S. Pat. Nos. 5,013,214 and 5,125,797 were issued to Applicant. These fans have been utilized mostly in de-smoking operations and were sometimes equipped with liquid spray nozzles for fire fighting. Because of relatively large turbine water flow rate, spray nozzles could utilize only a small fraction of water supplied to the turbine. Thus, two large supply and drain hoses were required to carry water flows of 50 to 60 gallons per minute to and from the fire. The weight of those fans was around 40 pounds and the fire fighter also needed to carry two heavy fire hoses.

Applicant was granted on Jul. 20, 1999 a patent (U.S. Pat. No. 5,924,286) on a very high speed, high efficiency very compact radial inflow hydraulic turbine. More specifically Applicant was granted on May 12, 2009 a patent for a high-velocity water misting gun capable of fighting a fire having approximately 2 MW of heat content. This patent is U.S. Pat. No. 7,530,553. Since its application date of May 8, 2006 further research in fighting larger "flash over" type fires has shown the need to increase the water misting gun fire fighting capacity up to 10 MW heat content. In order to effectively fight such fires from various distances, it is desirable to have water mist effective range and mist cone angle adjustable by varying air jet velocity, air mass flow rate and water mass flow rate adjustable independently from each other.

What is needed is a fire fighting device that can be used effectively in fighting larger flash over type fires with maximum protection of the fire fighting personnel.

SUMMARY OF THE INVENTION

The present invention provides a high-velocity water misting gun with a very high-speed radial inflow hydraulic turbine mounted on the same shaft with an axial flow air compressor wheel compressing air discharged at high velocities through an exhaust air nozzle. A preferred embodiment utilizes a plastic-metal hydraulic turbine wheel in which the plastic portion of the wheel other than blades is solidly anchored within a metal containing wheel. High pressure water drives the hydraulic turbine and provides water lubrication to high-speed bearings supporting a rotating shaft. The preferred embodiment utilizes hybrid bearings (part hydrodynamic, part hydrostatic) suitable for low-viscosity fluids such as water. Alternatively high speed ball bearings are utilized instead of hybrid water bearings. In the preferred embodiment all of the water discharging from the hydraulic turbine wheel is channeled directly into a water misting nozzle providing a fine water mist discharging into a high-velocity air flow provided by the axial-flow compressor. Thus, the entire water flow supplied to the misting gun is discharged into the high-velocity air flow discharging from an exhaust air nozzle so that no return hose is needed. Preferred embodiments utilize a manually operated ball valve to control water pressure supplied to the gun. A second valve is a manually operated turbine water bypass valve that is integral part of the preferred embodiment which allows for change of turbine power and air flow independently of water flow which allows for more effective fire fighting at closer distances. With turbine water bypass valve open, most of the turbine flow is bypassed around the turbine and directly into the water misting nozzle, increasing the water flow and decreasing the air flow and air velocity. With turbine water bypass valve fully closed, hydraulic turbine power increases the power input into the compressor resulting maximum reach of the water-air mist jet.

DETAILED DESCRIPTION OF THE PREFERRED EMBODIMENTS

First Preferred Embodiment

A first preferred embodiment can be described by reference to FIGS. 1-4.

Water Turbine Driven Air Compressor

Figure 1A:
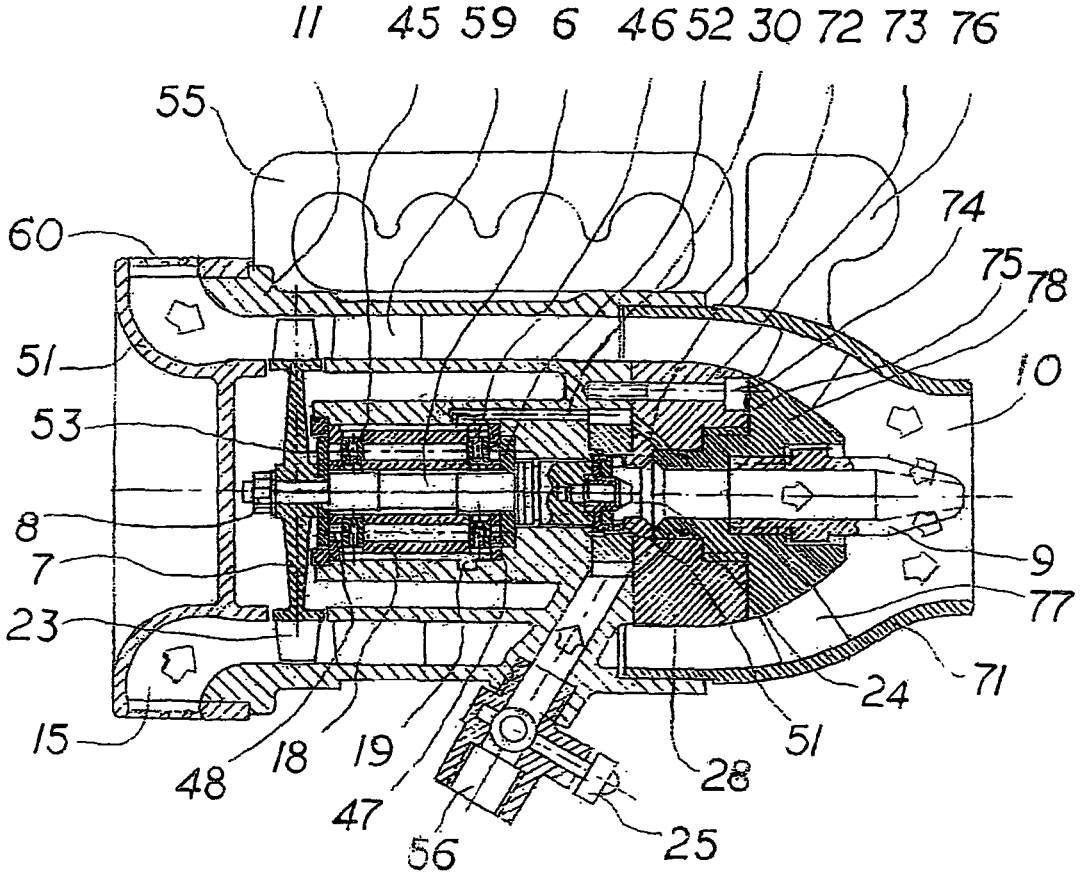
FIG. 1A is a drawing of a preferred embodiment of the present invention showing the turbine water bypass valve fully closed.
Figure 1B:
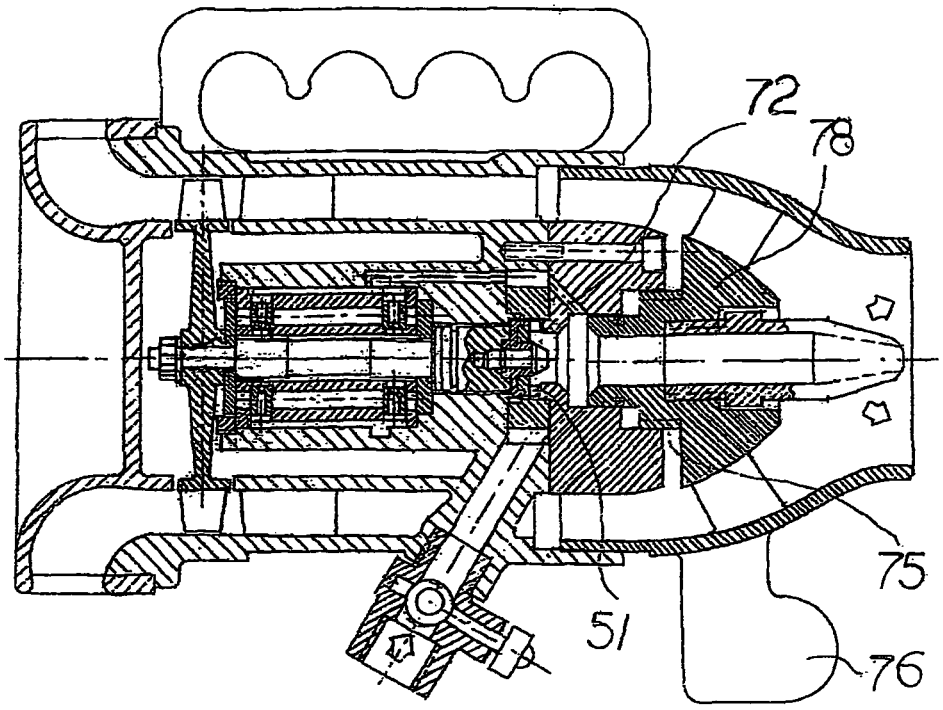
FIG. 1B is a drawing of a preferred embodiment showing the turbine water bypass valve fully open.
Figure 2:
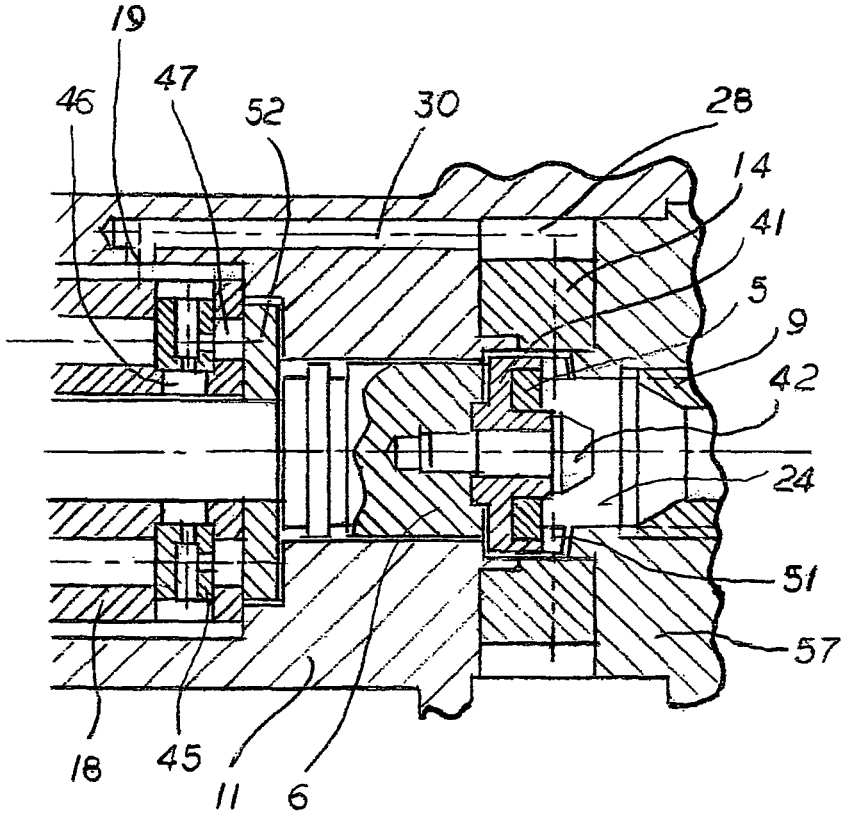
FIG. 2 show some important features of the preferred embodiment.

As shown in FIGS. 1A, 1B and 2, turbine wheel 5 is comprised of plastic and metal. As shown in FIG. 2, plastic portion 5 is solidly anchored within metal containing wheel 41 and solidly pressed onto shaft 6 via wheel nut 42. Compressor wheel 7 as shown in FIG. 1 is solidly attached to shaft 6 by hub nut 8. As shown in FIGS. 1A and 2, water discharging from turbine wheel blades 51 flows directly into water misting nozzle 9. Water mist droplets produced by water misting nozzle 9 are further broken down in size by high velocity air stream expanding through air nozzle 10. Jet of air flow carrying the water mist out of air nozzle 10 at high speed is produced by compressor rotor blades 23 in a standard combination with compressor stator blades 59. Compressor blades 23 are aerodynamically designed and this design has been checked in two-dimensional cascade tests of NACA 65 Series compressor blades as reported in NACA Report No. 1368. Optimized compressor design using such NACA 65 Series blades data has produced aerodynamic efficiencies in excess of 80 percent in subsonic compressors that have been designed and built by Applicant.

As shown in FIG. 1B the turbine water bypass passages 72 are fully open resulting in that most of the water is being bypassed around turbine wheel blades 51 which results increased water flow into water misting nozzle 9 and decrease in power produced by turbine wheel blades 51. This is achieved by turning adjustable bypass lever 76 counter clockwise by 180 degrees which turns turbine bypass center body 78 connected to adjustable bypass lever 76 via air nozzle vanes 77 and air nozzle body 71 by 180 degrees. Turbine bypass center body 78 incorporates spiral threads 75 which are engaged with matching threads in turbine cover 28. Turning of adjustable lever 26 turns turbine bypass center body 78 which results in axial motion of spiral threads 75 that are integral with turbine bypass center body 78. FIG. 1A shows fully closed turbine water bypass passages 72 and in FIG. 1B shows fully open turbine water bypass passages 72.

Water Bearings

Bearing cartridge 18 shown in FIGS. 1 and 2 contains two identical orifice compensated radial bearings 46 and two counter acting axial bearings formed with thrust collars 52 and 53. The function of orifice compensated bearing pockets 46 is explained below. As shown in FIGS. 1 and 2 bearing cartridge 18 incorporates orifice compensated radial bearing pockets 46 and axial bearing pockets 47. Thrust force produced by pressure differential across compressor blades 23 produces axial force acting on thrust collar 52 which is supported by water pressure in axial bearing pocket 47. Reverse thrust is counter acted by thrust bearing collar 53 in conjunction with reverse thrust bearing pockets 48. Reverse thrust load occurrence is unlikely although it is possible during aerodynamically unstable flow across compressor blades 23. Small amounts of bearing water, less than 1 gallon per minute leaks radially outward through small axial gap, less than 0.003 inch wide between bearing cartridge 18 and thrust collar 53 and into air flow exiting compressor blades 23 where it mixes further downstream with water mist in the air nozzle 10.

Orifice compensated bearings are needed to produce hydrostatic load carrying capability of radial and thrust bearings when lubricated with water. Water at such bearing velocities and clearances produces turbulent lubricating films as compared to engine oil (with much higher viscosity) that produces laminar oil films. Turbulent films alone without hydrostatically orifice compensated pockets are not capable of carrying bearing loads. Applicant has extensive experience in designing, manufacturing and testing of such turbulent film water lubricated bearings in sizes from 0.20 to 9.00 inch in diameter.

Water passage 30 provides high pressure water lubrication to bearing cartridge 18. Turbine inlet cavity 28 provides water flow to water passage 30. Turbine inlet cavity 28 is supplied with high pressure water via turbine inlet water passage 56 shown in FIG. 1, and turbine inlet flow control valve and high pressure water hose (not shown) but connected to turbine inlet water passage 56. Turbine housing cover 57 contains turbine nozzle ring 14 and provides close axial clearance to turbine blades 51 which are part of turbine wheel 5 shown in FIG. 2. Turbine housing cover 57 supports water misting nozzle 9. In the preferred embodiment the water misting nozzle 9 is a High Volume Spiral Design full cone spray nozzle with water flow capacity of 52.2 gallons per minute at 100 psi nozzle inlet pressure, commercially available at McMASTER-CARR Company in Los Angeles, Calif.

Compressor

Compressor blades 23 are solidly attached to compressor wheel 7. Water misting gun housing 11 is cast as one piece casting containing bearing cartridge 18 shown in FIGS. 1 and 2. Compressor stator vanes 59 and gun handle 56 are integrally cast as part of water misting gun housing 11. Protective screen 60 is attached to water misting gun housing 11 and 61 ahead of the compressor inlet passage 15. Function of the protective screen 60 is to prevent ingestion of outside debris into compressor blades 23. Water misting gun housing 11 and 61 incorporate compressor inlet passage 15 allowing for ambient air to enter into compressor blades 23 and stator blades 59 where the air is compressed and then expanded and discharged through the air nozzle 10. Water misting gun housing 11 is designed to contain the compressor blades 23 fragments in case of compressor blades 23 failure.

Water Turbine

Figure 3:
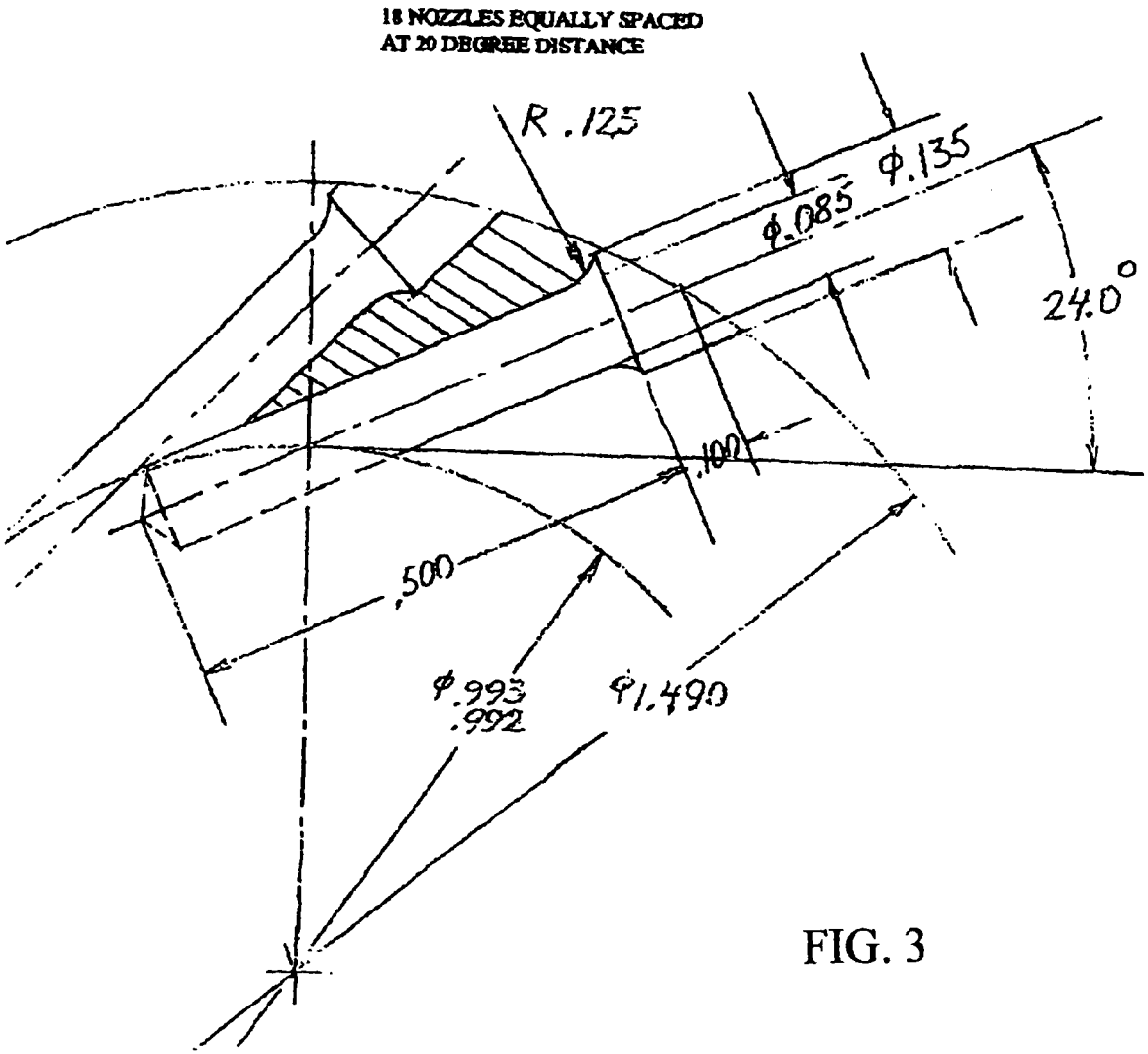
FIG. 3 shows a turbine nozzle design.
Figure 4:
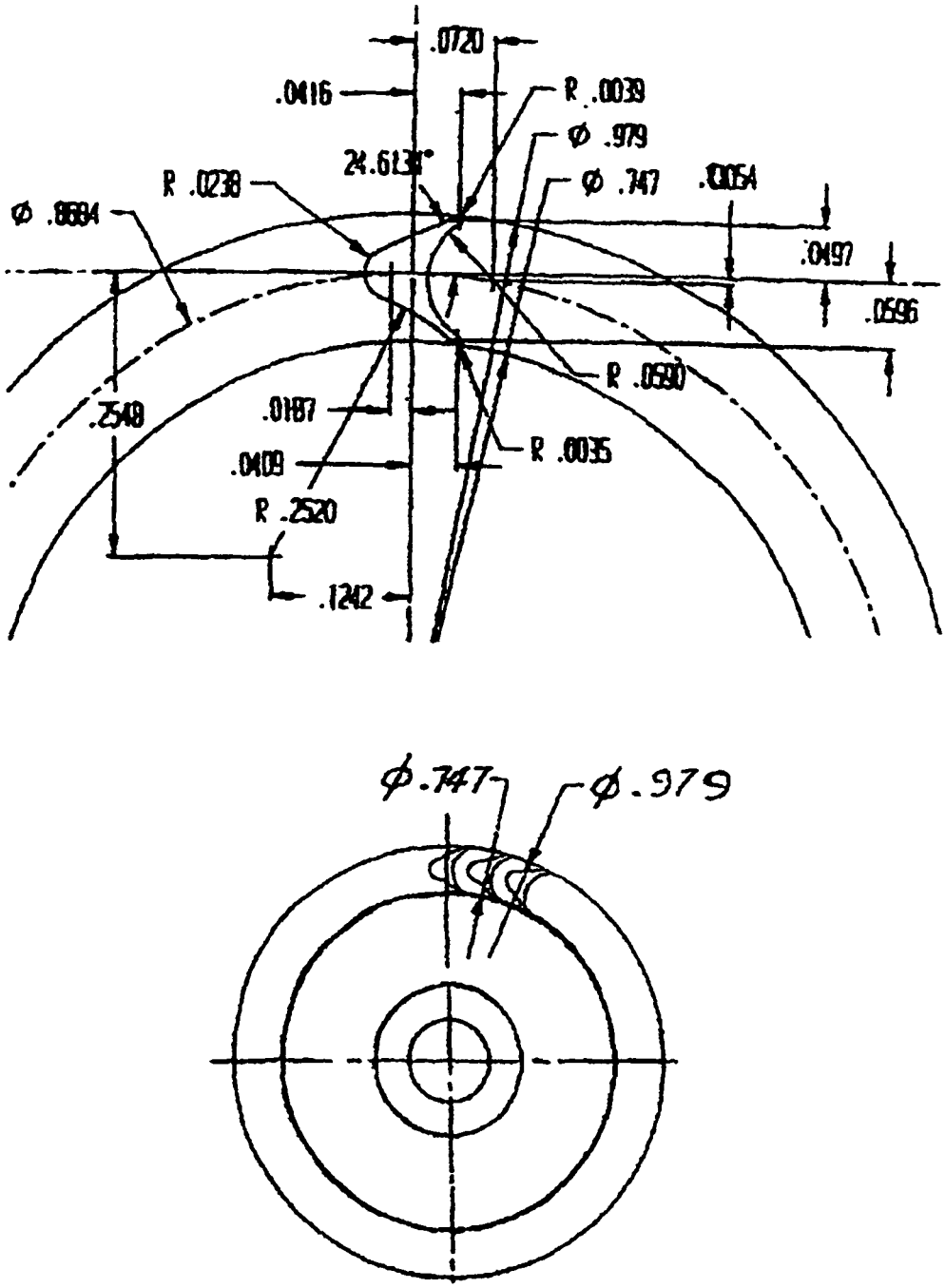
FIG. 4 shows a turbine wheel design.

High pressure water is supplied preferably at pressures of 400 to 500 pounds per square inch and at a rate of up to 70 gallons per minute into turbine inlet cavity 28 via turbine inlet passage 56. High pressure water flows through a series of nozzle holes optimally positioned in the turbine nozzle ring 14 driving turbine wheel blades 51 and turbine wheel 5 as shown in FIG. 2. Water discharging from turbine wheel 5 flows directly into the water misting nozzle 9 where water is being dispersed in a spiral fashion into expanding air flow exiting air nozzle 10 as a jet of air mixed with water droplets at 400 to 550 feet per second velocity that carries the water mist up to 80 to 90 feet distance. Turbine blades are shown in FIG. 4 and turbine nozzles are shown in FIG. 3.

The high-speed hydraulic turbine shown as turbine nozzles 14 and turbine wheel 5, produce about 6 HP @32,600 rpm with 500 psi supply pressure and 37 gallons per minute water flow. This is sufficient to drive axial flow compressor producing about 650 cfm air flow at 480 ft/sec air velocity and a water mist of up to 37 gallons per minute. The hydraulic turbine maximum capability has been tested by Applicant on other application at 1100 psi supply pressure producing ~30 HP @55,000 rpm. With water turbine bypass passages 72 fully open the water flow through the water misting nozzle is estimated to be in excess of 70 gallons per minute.

The hydraulic turbine utilizes the special geometry of turbine nozzles arrangement shown in FIG. 16-19 in U.S. Pat. No. 5,924,286, issued to the Applicant on Jul. 20, 1999, with the exception that the turbine shown in FIGS. 1 and 3 has turbine blades 51 height increased from 0.046 inch to 0.085 inch and the turbine nozzles 14 geometry defined as shown in FIG. 3.

Heat Absorbing Mist

Water and air mist flow containing 60 gallons per minute of water is capable of absorbing approximately 600,000 btu per minute of fire generated heat. If desired, capacity can be increased or decreased with the preferred embodiment by increasing or decreasing hydraulic turbine pressure in the range from about 400 psi to about 550 psi with resultant increase or decrease in flow capacities of water turbine wheel 5 and compressor blades 23.

High Pressure Water Supply Unit

A high pressure water supply unit is needed to deliver water to the high velocity water misting gun. Many special purpose fire trucks have the pressure-flow capability by the novel misting gun. Also, a wide choice of high pressure water supply pumps is available to supply the high pressure water needed to drive the above preferred embodiment. Engine driven and electric motor driven mobile units are available at pressures up to 500 psi and flows up to 80 gallons per minute. Northern Tool & Equipment Co., P.O. Box 1499, Burnsville, Minn. 55337-0499 has a large choice of such pump units for sale. Single or multiple pump units can be utilized to supply required high pressure water to power the misting gun. Pressure water hoses in lengths up to 100 ft, rated at 600 psi are available from Northern Tool Co. The 100 ft long hose weighs only 31 pounds and has 1.5 inch swivel connections allowing for longer hose extension. This allows fire fighters to quickly reach upper floors of multiple story dwellings. Ball valve 25 controls water flow to the gun.

Advantages of the Present Invention

The present invention provides a very compact hand held, water turbine driven very high speed axial flow compressor producing air jet with 400 to 500 ft/sec velocity capable of carrying up to 60 gallons per minute water in fine mist form to estimated distance of 80 to 90 feet. The gun uses only one light weight hose supplying high pressure water to drive a water turbine and uses the entire turbine water flow to generate fine mist for fire fighting. The gun provides water mist with extremely small water droplets by ejecting water through a high volume spiral design type spray nozzle and mixing them with 400 to 500 ft/sec air flow generated by the hydraulic turbine driven axial flow compressor. The gun is hand held.

Although the present invention has been described above in terms of a preferred embodiment, persons skilled in this art will recognize that many changes and additions could be made without departing from the spirit of the invention. For example, flow rates and pressures could be varied substantially. What is important is that all of the water driving the turbine to provide the air flow to carry the mist to the fire be turned into mist to be carried to the fire. Some modifications to the turbine design are possible; however, high speed turbines, similar to the one described, are greatly preferred. Therefore, the scope of the invention should be determined by the appended claims.

I claim:

1. A high-velocity water misting gun system comprising:

A) a main shaft,

B) at least two high-speed bearings supporting said main shaft,

C) an exhaust air nozzle,

D) a water misting nozzle adapted to discharge mist into the exhaust air nozzle, E) a very high-speed hydraulic turbine mounted on said main shaft and adapted to discharge water into the water misting nozzle, F) an air compressor wheel mounted on said main shaft for compressing air to be discharged through said exhaust air nozzle, G) a high pressure water supply for supplying water to drive the hydraulic turbine and provide lubrication to high-speed bearings supporting a rotating shaft and to be turned into mist and mixed with the compressed air discharged from said exhaust air nozzle, and H) a turbine bypass structure adapted to permit a portion of the water supply to bypass the turbine into the water misting nozzle.

2. The misting gun system as in claim 1 wherein the turbine bypass structure is a manually operated bypass valve structure.

3. The misting gun system as in claim 2 wherein the valve structure is adapted to permit the manually operated bypass structure to function over a range from fully closed to fully open.

4. The misting gun system as in claim 1 wherein the at least two-high speed bearings are two high-speed pre-lubricated ball bearings.

5. The misting gun system as in claim 1 wherein the at least two-high speed bearings are two water bearings.

6. The misting gun system as in claim 1 wherein all or substantially all of the water supplied by said water supply is turned into mist and mixed with the compressed air.

7. The misting gun system as in claim 1 wherein said hydraulic turbine is a radial inflow hydraulic turbine.

8. The misting gun system as in claim 1 wherein said hydraulic turbine is comprised of a plastic-metal hydraulic turbine wheel in which the plastic portion of the wheel other than blades is solidly anchored within a metal containing wheel.

9. The misting gun system as in claim 1 wherein said air compressor wheel is an axial flow compressor wheel.

10. The misting gun system as in claim 1 claim 5 wherein said water bearings are hybrid water bearings, part hydrodynamic and part hydrostatic.

11. The misting gun system as in claim 1 wherein said high pressure water supply comprises a gasoline pump.

12. The misting gun system as in claim 1 wherein said high pressure water supply comprises an electric pump.

13. The misting gun as in claim 1 and further comprising a manually operated ball valve to control water pressure supplied to the turbine.

* * * * *